US005564975A

United States Patent [19]

Northcutt

[11] Patent Number: 5,564,975

[45] Date of Patent: Oct. 15, 1996

[54] AIR FLOW CONTROLLER FOR HEATING AND AIR CONDITIONING VENTS

[76] Inventor: David T. Northcutt, 28 Thicket, Irvine, Calif. 92714

[21] Appl. No.: 527,163

[22] Filed: Sep. 12, 1995

[51] Int. Cl.[6] ..... F24F 13/10

[52] U.S. Cl. ..... 454/298; 454/292; 454/324

[58] Field of Search ..... 454/259, 270, 454/292, 296, 298, 324, 334

[56] References Cited

U.S. PATENT DOCUMENTS

| | | | |
|---|---|---|---|
| 4,945,822 | 8/1990 | Hicks et al. | 454/334 |
| 5,058,492 | 10/1991 | Norton | 454/259 |

FOREIGN PATENT DOCUMENTS

| | | | |
|---|---|---|---|
| 522923 | 12/1955 | Belgium | 454/292 |

*Primary Examiner*—Harold Joyce
*Attorney, Agent, or Firm*—Roy A. Ekstrand

[57] ABSTRACT

A pair of elongated channel supports each defining inwardly open channels are secured to the undersurfaces of a parallel pair of ceiling rails. The channel supports are positioned on each side of a ceiling air flow vent. A pair of generally planar control panels are slidably movable within the channels and extend between the channel supports. The panels are movable between alternative positions within the channels to cover all or part of the air flow vent and thereby control air flow therethrough. In an alternate embodiment, the pair of generally planar control panels are replaced by a single larger panel which is similarly movable within the channels of the channel supports.

16 Claims, 2 Drawing Sheets

AIR FLOW CONTROLLER FOR HEATING AND AIR CONDITIONING VENTS

FIELD OF THE INVENTION

This invention relates generally to heating and air conditioning systems and particularly to air flow diffusers and controllers used in combination therewith.

BACKGROUND OF THE INVENTION

In a typical office environment, commercial building, and many residential environments, heating and air conditioning is provided through a plurality of air flow ducts which terminate in air discharge vents within the room interiors. In many such facilities and structures, the room ceilings are fabricated using the well known suspended ceiling apparatus. Such suspended ceilings are so named due to their use of a plurality of criss-crossing rails usually suspended from the upper ceiling supports of the room. In most installations, the suspended rails form a grid having equal sized spaces therein such as two foot squares within which correspondingly sized ceiling tiles formed of lightweight acoustic material are supported. In most facilities using suspended ceilings, the ceiling rail grid is further utilized to support both lighting fixtures and heating and air conditioning vents. Most commonly, such lighting fixtures and vents are sized to fit in place of one or more of the ceiling tiles. The resulting ceiling is cost effective to fabricate and is generally pleasing to the eye due to the flush mounting of the light fixtures and heating and air conditioning vents within the suspended rail grid.

Unfortunately, however, despite the aesthetic appeal and the cost effectiveness of such suspended ceilings, the placement of heating and air conditioning vents is often selected in accordance with the needs of light fixture placement as well as the efficiency of air circulation and flow rather than the likely seating locations of the inhabitants of the room. As a result, people within such environments must often tolerate undesired air flow patterns which can include drafts and annoying wind as the heating and air conditioning system cycles through its environmental control. To further exacerbate the problem, most environmental control systems within human environments utilize air circulation systems which operate in both heating and air conditioning modes. While draft and wind problems can be a source of annoyance in the operation of the heating system, they are of much greater annoyance in operation of the air conditioning system. Undesired drafts of cold air over long period times of time can cause inhabitants of the structure substantial discomfort and even illness.

Practitioners in the heating and air conditioning arts have for many years been aware of such problems and, in response thereto, have endeavored to provide various diffusers, grilles and other air flow control devices all directed toward avoiding draft and air flow problems. For example, U.S. Pat. No. 3,690,243 issued to Lambert sets forth a SUSPENDED CEILING FRAMEWORK SUPPORT TROFFER AIR DISTRIBUTION SYSTEM having continuous arrays or rows of resilient inverted channel members each having the lower feet thereof separated in a natural state and contracted for insertion on and between the runners of a suspended ceiling framework. Air control means extend between the runners and ceiling tile are inserted between the runners and the air control means to close the channel members for conducting air there along.

U.S. Pat. No. 3,757,667 issued to Lambert sets forth a PLUG-IN AIR DIFFUSER SUBASSEMBLY FOR A VARIETY OF SUSPENDED CEILING FRAMEWORK having a pair of opposed and spaced end walls to which side walls are riveted to form an air distribution passage therethrough. A pair of spaced protrusions extend laterally from the end walls and inwardly to the subassembly to frictionally mount a pair of cambered nested weirs in the air distribution passage. The subassembly plugs into a space formed between a pair of parallel inverted T-bar cross runners.

U.S. Pat. No. 4,506,828 issued to Grant sets forth REVERSIBLE DAMPER MEANS having a multiplicity of damper blades rotatably mounted in housing means to control and regulate the flow of a heating/cooling medium into individual rooms or zones served by a central appliance. The damper blades are opened and closed by a reversible motor connected to a driver blade and all other blades are interconnected by linkage means.

U.S. Pat. No. 4,417,687 issued to Grant sets forth a MULTI-BLADE AUTOMATIC AIR REGISTER DAMPER for use in air registers installed over furnace duct boots terminating in recesses of floors, ceilings or walls of dwellings. The damper blades are attached to a gear train and are pivotally mounted in a damper housing assembly. The blades are rotatable between open and closed positions by a motor driven damper blade.

U.S. Pat. No. 4,375,183 issued to Lynch sets forth an INSULATED SHUTTER ASSEMBLY for installation in a ceiling or other wall of a building for use in combination with a ventilating fan. The shutter assembly is insulated to substantially prevent heat transfer by conduction and convection through the shutter assembly when it is closed. An integrated mechanical lock system is used with the shutter assembly to provide a positive force against elastic seals when the shutters are closed.

U.S. Pat. Re.30953, a reissue of U.S. Pat. No. 4,231,513 issued to Noll, et al. sets forth a THERMALLY ACTUATED DIFFUSER for an air conditioning system which incorporates a self contained and integrated sensor actuator for varying the volume of conditioned air passing through the diffuser in response to room temperature.

U.S. Pat. No. 4,231,253 issued to Faith, et al. sets forth an AIR-FLOW CAPTURE AND CONTROL DEVICE FOR FLOW MEASUREMENT having an air flow measuring box supporting four curtains which are drawn or released together to set the measuring aperture of the measuring box at a desired area and linear velocity flow.

U.S. Pat. No. 3,699,871 issued to Larkfeldt sets forth a SUPPLY AIR DEVICE FOR INJECTION OF PREFERABLY COLD VENTILATION AIR adapted to be mounted adjacent one edge of a hung ceiling. The device includes a pressure box having an air distribution chamber in its bottom formed between a pair of perforated plates which operate to distribute the air vertically downward and eliminate any horizontal component of air flow in the duct.

While the foregoing described prior art devices have in some instances improved the related arts, they have thus far failed to solve the basic problems described above and meet the as yet unsatisfied need for a simple, low cost, and easily installed and operated apparatus for adjusting and controlling heat and air conditioning air flow within a room environment. There remains therefore a need in the art for evermore improved, easy to use, low in cost and simple to install air flow controllers for heating and air conditioning vents.

SUMMARY OF THE INVENTION

Accordingly, it is a general object of the present invention to provide an improved air flow controller for heating and air conditioning vents. It is a more particular object of the present invention to provide an improved air flow controller for heating and air conditioning vents which is low in cost and easy to install in a suspended ceiling environment or the like. It is a still more particular object of the present invention to provide an improved air flow controller for heating and air conditioning vents which effectively diffuses and redirects the direct air flow components of heating and air conditioning vents.

In accordance with the present invention, there is provided for use in combination with a suspended ceiling having a plurality of parallel rails and an air flow vent positioned between a pair of the rails, an air flow controller comprising: a pair of elongated channel supports each defining an open channel therein; attachment means for attaching the pair of channel supports to a pair of the rails on opposed sides of the air flow vent such that the open channels in the channel supports each face inwardly; and at least one generally planar control panel having opposed ends received within the open channels, the at least one panel being movable to cover a portion of the air flow vent or to be offset from the air flow vent.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figures 1, 2, 3:
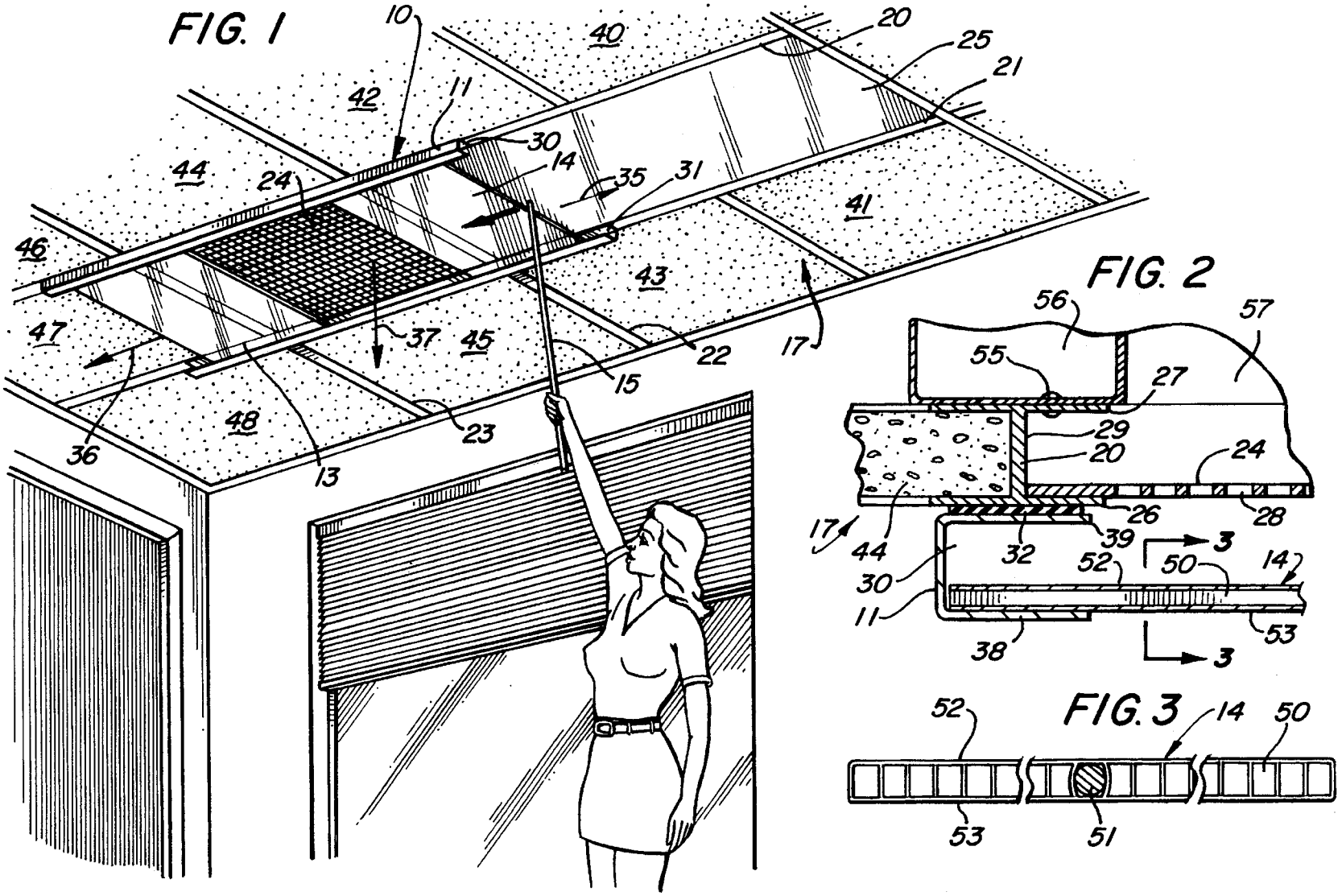
FIG. 1 sets forth a perspective view of an air flow controller for heating and air conditioning vents in a typical installation and use.
FIG. 2 sets forth a partial section view of the present invention air flow controller.
FIG. 3 sets forth a partial section view of the present invention air flow controller taken along section lines 3—3 in FIG. 2.

FIG. 1 sets forth a perspective view of an air flow controller constructed in accordance with the present invention and generally referenced by numeral 10. Air flow controller 10 is shown in a typical suspended ceiling installation such as an office environment or the like. Thus, a conventional ceiling generally referenced by numeral 17 comprises a so-called suspended ceiling in which a plurality of rails such as rails 20 through 23 form a grid-like pattern which in turn supports a plurality of ceiling tiles such as ceiling tiles 40 through 48. In accordance with conventional fabrication techniques, the rails of ceiling 17 are set in a generally rectilinear grid defining square or rectangular spaces therebetween. Ceiling 17 also supports a light fixture (not shown) above the plane of rails 20 through 23 and a translucent light panel 25. In further accordance with conventional fabrication techniques, light panel 25 spans a pair of adjacent grid portions of rails 20 through 23. Thus, light panel 25 is essentially twice the size or area of ceiling tiles 40 through 48. In further accordance with conventional fabrication techniques, a vent grille 24 defining a plurality of apertures and better seen in FIG. 2 is supported within ceiling 17. More specifically, vent grille 25 corresponds in size to a ceiling tile and thus occupies one grid space of rails 20 through 23. In this instance, vent grille 24 occupies the space between rails 20 and 21 on one side and rails 22 and 23 on the opposite sides. Thus, vent grille 24, essentially replaces a ceiling tile within its grid space. In further accordance with conventional fabrication techniques, an air flow duct (not shown) is coupled to vent grille 24 such that a flow of forced air is forced downwardly through vent grille 24 in the direction indicated by arrow 37.

Ceiling 17 as thus far described is entirely conventional in its fabrication and is intended to be illustrative of a typical conventional suspended ceiling. It will be apparent to those skilled in the art from the descriptions which follow that the present invention air flow controller described below is equally applicable to other types of suspended ceilings or other ceilings having grid-like rail patterns. Thus, for example, air flow controller 10 may be used equally well with suspended ceilings having non-square or elongated rectangular tiled grids without departing from the spirit and scope of the present invention.

In accordance with the present invention, air flow controller 10 includes a pair of elongated channel supports 11 and 12 each defining a generally U-shaped cross-section. Accordingly, channel supports 11 and 12 define elongated channels 30 and 31 respectively extending substantially or entirely the length of channel supports 11 and 12. In their preferred form, channel supports 11 and 12 are fabricated of an extruded or molded plastic material or the like. However, it will be apparent to those skilled in the art that other materials having sufficient rigidity and strength may be utilized in forming channel supports 11 and 12 without departing from the spirit and scope of the present invention. Channel supports 11 and 12 are secured to the undersurfaces of rails 20 and 21 in the manner described below in greater detail in FIG. 2. However, suffice it to note here that channel supports 11 and 12 utilize a plurality of magnetic pads such as magnetic pads 32 through 34 shown in FIG. 4. The use of magnetic pads for attachment of channel supports 11 and 12 is particularly advantageous in view of the customary fabrication of rails 20 and 21 from a magnetic steel material. It will be apparent to those skilled in the art that in the event nonmagnetic rails are utilized in ceiling 17, alternative attachments such as the attachments shown in FIGS. 5 and 8 may be utilized without departing from the spirit and scope of the present invention.

Channel supports 11 and 12 are attached to rails 20 and 21 such that channels 30 and 31 face inwardly. In addition, channel supports 11 and 12 are preferably positioned upon rails 20 and 21 so as to span grille 24 on each side. A pair of generally planar control panels 13 and 14 are slidably received within channels 30 and 31 of supports 11 and 12 in the manner shown in FIG. 1. In the preferred fabrication of the present invention, panels 13 and 14 are fabricated of a clear or translucent material to avoid blocking light should they be moved to a position such as that shown in FIG. 1 for panel 14. But for the translucent or clear material fabrication of panel 14, the position of the panel as shown in FIG. 1 would interfere with the light output of light panel 25.

In further accordance with the present invention, panels 13 and 14 are slidably movable within channels 30 and 31 to provide the desired degree of coverage of vent grille 24. Thus, for example, in the event it is desired to substantially block vent grille 24, the user simply slides panels 13 and 14 together such that they meet at the approximate center of vent grille 24 thereby covering the entire vent grille. Conversely, in the event it is desired to completely expose vent grille 24, the user simply slides panels 13 and 14 outwardly to expose the maximum amount of vent grille 24. As is seen in FIG. 1, intermediate positions of partial covering of vent grille 24 may also be utilized by suitably positioning panels 13 and 14.

In accordance with the present invention, channel supports 11 and 12 support panels 13 and 14 in a spaced relationship to vent grille 24 as well as ceiling tile 47 and light panel 25. This spacing is better seen in FIG. 2. However, suffice it to note here that due to this spacing between panels 13 and 14 and the undersurface of ceiling 17, the air flow normally directed downwardly from vent grille 24 is divided into three components. These three air flow components comprise a downward air stream indicated by arrow 37 as well as oppositely directed laterally directed air flows as indicated by arrows 35 and 36. The relative proportions of downward air flow to lateral air flow is determined largely by the positions of panels 13 and 14 with respect to vent grille 24. If, for example, panels 13 and 14 are moved together completely covering vent grille 24, then virtually all of the air flow is found in lateral air flows as indicated by arrows 35 and 36. Conversely, in the event panels 13 and 14 are fully separated to expose the entire surface of vent grille 24, virtually all air flow is downwardly directed as indicated by arrow 37. It will be apparent to those skilled in the art that intermediate positions of panels 13 and 14 result in intermediate proportions of air flow in the downward and lateral directions.

In the preferred fabrication of the present invention, panels 13 and 14 are loosely fitted within channels 30 and 31 and thus are easily moved to the desired position. To facilitate easy adjustment of panels 13 and 14, an elongated rod 15 is provided which the user is able to employ in adjusting the air flow controller. As is shown in FIG. 1, the user is able to utilize rod 15 against the outer edge of panel 14 and thereby exert an inward force in the direction indicated by arrow 16 to slide panel 14 toward vent grille 24. A similar operation, of course, is then employed upon panel 13 if desired to adjust the position of panel 13. Panels 13 and 14 are of course easily movable in either direction using rod 15 in the manner shown.

FIG. 2 sets forth a partial section view of the present invention air flow controller. As described above in FIG. 1, ceiling 17 is constructed in accordance with conventional fabrication techniques and includes a plurality of rails such as rail 20 shown in FIG. 2. Rail 20 defines an I-beam cross-section having a vertical web 29, a lower flange 26 and an upper flange 27. In further accordance with conventional fabrication techniques, rail 20 is supported in a suspended manner by a rail support 56 utilizing a fastener 55 secured to flange 27. A ceiling tile 44 is shown resting upon and supported by flange 26 of rail 20. In addition, a vent grille 24 having a plurality of apertures 28 formed therein is also supported by flange 26 of rail 20. An air flow duct 57 is aligned with vent grille 24 and, in accordance with conventional heating and air conditioning fabrication techniques provides a source of heating or cooling air under pressure to be forced downwardly through vent grille 24.

In accordance with the present invention, a generally U-shaped channel support 11 defining an interior channel 30 and having an upper lip 39 and a lower lip 38 is attached to flange 26 of rail 20 by a magnetic path 32. As mentioned above, channel support 11 is preferably fabricated of an extruded or molded plastic material or the like. Thus, magnetic pad 32 is preferably secured to upper lip 39 using a conventional attachment method or adhesive bonding or the like. Because rail 20 is fabricated of a magnetic material such as steel, magnetic pad 32 provides an attaching force to secure pad 32 and thereby channel support 11 to the undersurface of flange 26. In further accordance with the present invention, a generally planar flow control panel 14 is received within channel 30 and rests upon lower lip 38 of channel support 11 as shown. In the embodiment shown in FIGS. 1 through 3, panel 14 is fabricated of a clear or translucent material such as plastic or the like having sufficient rigidity to span the distance between channel supports 11 and 12 in the manner shown in FIG. 1 without excessive sagging. Toward this end, panel 14 is formed of an upper surface 52, a lower surface 53 and a plurality of passages 50 extending therethrough in the manner shown in FIG. 3. The resulting structure forms a "corrugated" type structure as is best seen in FIG. 3 which provides a maximum of strength while maintaining the lightweight character of the panel. This lightweight character facilitates the easy sliding of panel 14 upon lip 38 of channel support 11 and thus facilitates the air flow adjustment described above in FIG. 1.

FIG. 3 sets forth a section view of panel 14 taken along section lines 3—3 in FIG. 2. As described, panel 14 is preferably formed of a lightweight plastic material or the like and defines an upper surface 52, a lower surface 53 and a plurality of passages 50 therethrough. The resulting structure corresponds generally to a "corrugated" or honeycomb-type structure having lightweight and high strength. Panel 14 may, if desired, be further strengthened against sagging by inserting one or more elongated steel or rigid plastic rods through one or more of passages 50 in the manner shown for rod 51. In addition, rod 51 may be slightly precurved in the upward direction to provide a still greater antisagging rigidity to further strengthen panel 14. It will be understood by those skilled in the art that panels 13 and 14 are substantially identical and thus the descriptions in FIGS. 2 and 3 relating to panel 14 should be understood to apply equally well to panel 13. It will be apparent to those skilled in the art that panels 13 and 14 may be fabricated of various other materials such as foam core plastic, or the like, without departing from the spirit and scope of the present invention. The essential characteristics of panels 13 and 14 desired in the present invention are the provision of relatively high strength, lightweight panels capable of supporting their respective weights without excessive sagging when received within channels 30 and 31 of channel supports 11 and 12 (seen in FIG. 1).

Figures 4, 5, 6, 7, 8:
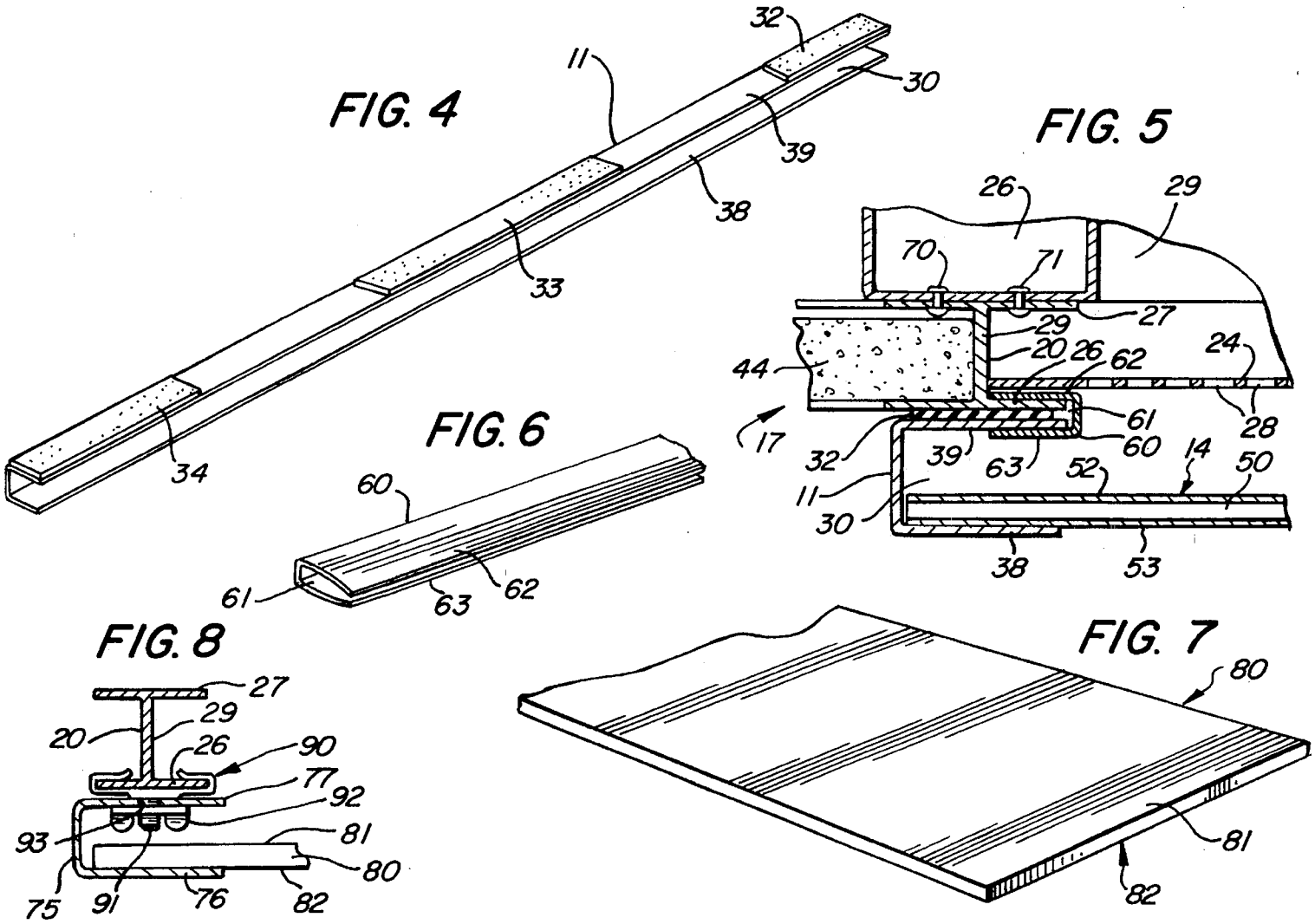
FIG. 4 sets forth a perspective view of an end channel used in the present invention air flow controller.
FIG. 5 sets forth a partial section view of an alternate embodiment of the present invention air flow controller.
FIG. 6 sets forth a partial perspective view of an attachment clip utilized in the present invention air flow controller.
FIG. 7 sets forth a partial perspective view of a typical shutter plane utilized in the present invention air flow controller.
FIG. 8 sets forth a partial section view of a still further alternate embodiment of the present invention air flow controller.

FIG. 4 sets forth a perspective view of channel support 11. It will be understood by those skilled in the art that while channel support 11 is shown in FIG. 4, channel support 12 is fabricated in an identical manner. Thus, the descriptions of channel support 11 set forth herein should be understood to apply equally well to channel support 12. Accordingly, channel support 11 defines an elongated support having a generally U-shaped cross-section and defining an interior channel 30 therein. Channel support 11 includes an upper lip 39 and a lower lip 38 extending in a generally parallel spaced arrangement to form channel 30 therebetween. In further accordance with the present invention, a plurality of magnetic pads 32, 33 and 34 are secured to upper lip 39 of channel support 11 using conventional attachment means such as adhesive bonding or the like.

FIG. 5 sets forth a partial section view of an alternate embodiment of the present invention air controller secured to ceiling 17. By way of overview, the alternate embodiment shown in FIG. 5 differs from the embodiment shown in FIG. 2 in that an additional retaining clip 60 (seen in FIG. 6) is secured to the channel support to provide additional attachment for the channel support to the ceiling rail. In all other respects, the embodiment shown in FIG. 5 is substantially identical to the embodiment shown in FIG. 2.

More specifically, FIG. 5 sets forth ceiling 17 which in accordance with the above-described conventional fabrication techniques includes a rail support 26 supporting a rail 20 which in turn supports a tile 44 and a vent grille 24. The latter defines a plurality of vent apertures 28 and is positioned beneath an air flow duct 29. As is also described above, rail 20 includes a center web 29, a lower flange 26 and an upper flange 27. The latter is secured to rail support 26 by a plurality of fasteners such as fasteners 70 and 71.

In accordance with the present invention, an elongated generally U-shaped channel support 11 defines an interior channel 30, an upper lip 39 and a lower lip 38. Thus, the open side of channel 30 faces inwardly toward vent grille 24 and, more importantly, toward channel support 12 (seen in FIG. 1) supported on the opposite side of vent grille 24. In further accordance with the present invention, lightweight panel 14 defines an upper surface 52, a lower surface 53 and a plurality of passages 50. Panel 14 is slidably received within channel 30 resting upon lower lip 38. A magnetic pad 32 is secured to the upper surface of lip 39 and provides magnetic attachment to flange 26 of rail 20. To further secure channel support 11 to rail 20, a clip 60 formed of a resilient material and defining a generally U-shaped cross-section (better seen in FIG. 6) is secured to flange 26 of rail 20 and lip 39 of channel support 11. Clip 60 defines an interior channel 61 and a pair of flexible inwardly curved lips 62 and 63 which provide a resilient grasping force when secured to flange 26 and lip 39 in the manner shown. Thus, while magnetic attachment of magnetic pads such as pad 32 is believed to provide sufficient attaching force for the present invention channel supports, it may be desirable in some installations to utilize clip 60 in the manner shown in FIG. 5. For example, in the event the present invention air flow controller is utilized in buildings having significant vibration levels or in areas subject to disturbances such as earthquakes or the like, the additional attachment using clip 60 provides a measure of additional security for channel support attachment. While not shown in FIG. 5, it will be apparent to those skilled in the art that in the preferred utilization of the embodiment of the present invention shown in FIG. 5, a second clip identical to clip 60 is utilized upon channel support 12 (seen in FIG. 1) to similarly secure channel support 12 in the position shown in FIG. 1.

FIG. 6 sets forth a partial perspective view of clip 60. As described above, clip 60 defines a generally U-shaped cross-section and is preferably fabricated of a resilient material such as extruded or molded plastic or the like. Clip 60 defines an interior channel 61 and a pair of inwardly curved lips 62 and 63.

FIG. 7 sets forth a partial perspective view of an alternate embodiment of the present invention utilizing a larger panel 80 having a substantially greater width than panels 13 or 14 shown in FIG. 1. Panel 80 defines an upper surface 81 and a lower surface 82 and is preferably fabricated of a lightweight material. In the utilization of panel 80, and with temporary reference to FIG. 1, panel 80 is sufficient in dimension to be used in place of panels 13 and 14. Thus, a single panel of greater width such as panel 80 is slidable within channels 30 and 31 and moves in the same manner as shown for panels 13 and 14 in FIG. 1. The difference in the use of panel 80, however, is the utilization of a single greater width panel in place of a pair of converging or separating panels such as panels 13 and 14.

FIG. 8 sets forth a partial section view of a still further alternate embodiment of the present invention in which a different fastener is utilized in securing the channel support to the suspended ceiling rails. More specifically, FIG. 8 shows an elongated generally U-shaped channel support 75 having an upper lip 77 and a lower lip 76. A panel such as panel 80 having an upper surface 81 and a lower surface 82 is received within channel support 75 and rests upon lower lip 76. Channel support 75 differs from channel supports 11 and 12 set forth above in that a plurality of apertures such as aperture 93 are formed in upper lip 77 thereof. Correspondingly, a twist clip 90 constructed in accordance with conventional fabrication techniques is received upon lower flange 26 of rail 20 in a twist attachment such that threaded fastener 91 extends downwardly from twist clip 90 and passes through aperture 93 of channel support 75. In further accordance with conventional fabrication techniques for twist clip 90, a wing nut 92 is threadably received upon fastener 91 to secure channel support 75. As mentioned above, twist clip 90 may be fabricated entirely in accordance with conventional fabrication techniques and may, for example, comprise a twist clip having catalog number AG9 and manufactured by Caddy Corporation or its equivalent. The essential aspect of utilizing twist clip 90 is to provide additional or alternative means for securing channel supports to ceiling rails in the manner shown in FIG. 8. It will be apparent to those skilled in the art that still different variations of attachment means may be utilized in securing channel supports of the present invention to conventional ceiling rails to practice the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a suspended ceiling having a plurality of parallel rails and an air flow vent positioned between a pair of said rails, an air flow controller comprising:

a pair of elongated channel supports each defining an open channel therein;

attachment means for attaching said pair of channel supports to a pair of said rails on opposed sides of said air flow vent such that said open channels in said channel supports each face inwardly; and at least one generally planar control panel having opposed ends received within said open channels, said at least one panel being movable to cover a portion of said air flow vent or to be offset from said air flow vent.

2. An air flow controller as set forth in claim 1 wherein said pair of elongated channel supports each define an upper surface and wherein said attachment means includes a plurality of magnets secured to said upper surface for magnetically attracting said pair of rails.

3. An air flow controller as set forth in claim 2 wherein said attachment means further includes a plurality of clips securable to said pair of rails and said pair of elongated channel supports.

4. An air flow controller as set forth in claim 3 wherein said pair of elongated channel supports each define a generally U-shaped cross-section.

5. An air flow controller as set forth in claim 4 wherein said at least one generally planar control panel defines an upper surface, a lower surface and a plurality of passages.

6. An air flow controller as set forth in claim 5 wherein said at least one generally planar control panel further includes an elongated rigid rod received within one of said passages.

7. An air flow controller as set forth in claim 6 wherein said at least one panel is formed of a light transmissive material.

8. An air flow controller as set forth in claim 1 wherein said at least one panel is formed of a light transmissive material.

9. An air flow controller as set forth in claim 1 wherein said at least one generally planar control panel includes a pair of panels movable within said channels.

10. An air flow controller as set forth in claim 1 further including an elongated rod having a first end for being held by a user and a second end for imparting a lateral force against said at least one generally planar control panel for moving said panel within said channels.

11. For use in a room having a ceiling formed of a grid pattern of suspended rails and supporting a plurality of ceiling tiles and an air flow vent within said grid pattern, an air flow controller comprising:

first and second elongated channel supports each defining a channel therein;

first and second generally planar control panels each having opposed edges; and attachment means for securing said first and second channel supports to a pair of said suspended rails on opposite sides of said air flow vent such that said channels face inwardly and such that said opposed edges of each of said first and second control panels are slidably received within said channels, said control panels being movable between a closed position generally covering said vent and an open position exposing said vent.

12. An air flow controller as set forth in claim 11 wherein said first and second channel supports define respective first and second upper surfaces supporting said attachment means and wherein said channels slidably support said control panels in a spaced relationship to said vent and said ceiling.

13. An air flow controller as set forth in claim 12 wherein said attachment means includes a plurality of magnets secured to said first and second upper surfaces.

14. An air flow controller as set forth in claim 13 wherein said attachment means further includes a plurality of generally U-shaped elongated resilient clips secured to said rails and said channel supports.

15. An air flow controller as set forth in claim 11 wherein said attachment means further includes a plurality of generally U-shaped elongated resilient clips secured to said rails and said channel supports.

16. For use in a room having a ceiling formed of a grid pattern of suspended rails and supporting a plurality of ceiling tiles and an air flow vent within said grid pattern, an air flow controller comprising:

a pair of generally planar control panels; and panel support means slidably supporting said pair of panels in a spaced relationship to said air flow vent, said control panels being movable between a closed position substantially covering said vent and causing air flow from said vent to be diverted laterally along said control panels and an open position exposing at least a portion of said vent causing air flow from said vent to travel downwardly between said control panels and dividing air flow from said vent to cause a portion to flow laterally and a portion to flow downwardly when said control panels are positioned between said open and closed positions.

* * * * *